US006509678B2

(12) United States Patent
Shen

(10) Patent No.: US 6,509,678 B2
(45) Date of Patent: Jan. 21, 2003

(54) CLAMPING STRUCTURE ASSEMBLY OF PROJECTION LAMP

(76) Inventor: Wei Hong Shen, 6F, No. 649-9, Chung Cheng Rd., Hsinchuang City, Taipei Hsien (TW)

( * ) Notice: Subject to any disclaimer, the term of this patent is extended or adjusted under 35 U.S.C. 154(b) by 26 days.

(21) Appl. No.: 09/853,615

(22) Filed: May 14, 2001

(65) Prior Publication Data

US 2002/0167257 A1 Nov. 14, 2002

(51) Int. Cl.[7] ..... H01J 5/48
(52) U.S. Cl. ..... 313/318.01; 313/318.1; 362/396; 362/414; 439/358; 439/370
(58) Field of Search ..... 313/318.01, 318.1; 362/396, 414; 439/356, 358, 370

(56) References Cited

U.S. PATENT DOCUMENTS 4,219,870 A * 8/1980 Haraden et al. ..... 326/226
4,390,927 A * 6/1983 Von Feldt ..... 362/191
4,523,256 A * 6/1985 Small ..... 362/11
5,339,233 A * 8/1994 Yang ..... 362/402
6,242,853 B1 * 6/2001 Mulholland ..... 313/318.01
6,270,235 B1 * 8/2001 Coushaine ..... 362/226
6,419,370 B1 * 7/2002 Chen ..... 362/98

* cited by examiner

*Primary Examiner*—Tho D. Ta
*Assistant Examiner*—Ann McCamey
(74) *Attorney, Agent, or Firm*—Rabin & Berdo, P.C.

(57) ABSTRACT

A clamping structure of projection lamp comprises a shade assembly, a lamp cup and a clamping tongue. The shade assembly has an insulating body with two grooves on two outer walls thereof. The lamp cup has two leads connected to the shade assembly. The lamp cup has two grooves on two outer walls thereof. The clamping tongue has a resilient main body having a plurality of upper arms and lower arms on two opposite sides thereof. The upper arm has upper clamping part and the lower arm has lower clamping part. The upper clamping parts of the upper arms clamp the grooves of the shade assembly and the lower clamping parts of the lower arms clamp the grooves of the lamp cup such that the lamp cup is elastically connected to the shade assembly.

3 Claims, 6 Drawing Sheets

CLAMPING STRUCTURE ASSEMBLY OF PROJECTION LAMP

FIELD OF THE INVENTION

The present invention relates to a clamping structure of projection lamp, especially to a clamping structure of projection lamp, which can clamp the cup to the shade assembly of projection lamp, whereby the cup can be easily assembled and disassembled.

BACKGROUND OF THE INVENTION

The lamps become of increasing importance for decoration. Diversity type of lamps such as projection lamp, ceiling lamp, hanging lamp, table lamp and desktop lamp are developed to satisfy user's need.

In prior art projection lamp; the lamp cup 2*a* thereof is assembled within the shade assembly of projection lamp 1*a*. The assembling and disassembling of the cup 2*a* is cumbersome and difficult.

SUMMARY OF THE INVENTION

It is the object of the present invention to provide a clamping structure of projection lamp, which can clamp the lamp cup to the shade assembly by a clamping tongue, whereby; the cup can be easily assembled and disassembled.

To achieve above object, the present invention provides a clamping structure of projection lamp comprises a shade assembly, a lamp cup and a clamping tongue. The shade assembly has an insulating body with two grooves on two outer walls thereof. The lamp cup has two leads connected to the shade assembly. The lamp cup has two grooves on two outer walls thereof. The clamping tongue has a resilient main body having a plurality of upper arms and lower arms on two opposite sides thereof. The upper arm has upper clamping part and the lower arm has lower clamping part. The upper clamping parts of the upper arms clamp the grooves of the shade assembly and the lower clamping parts of the lower arms clamp the grooves of the lamp cup such that the lamp cup is elastically connected to the shade assembly.

The various objects and advantages of the present invention will be more readily understood from the following detailed description when read in conjunction with the appended drawing, in which:

DETAILED DESCRIPTION OF THE INVENTION

Figure 1:
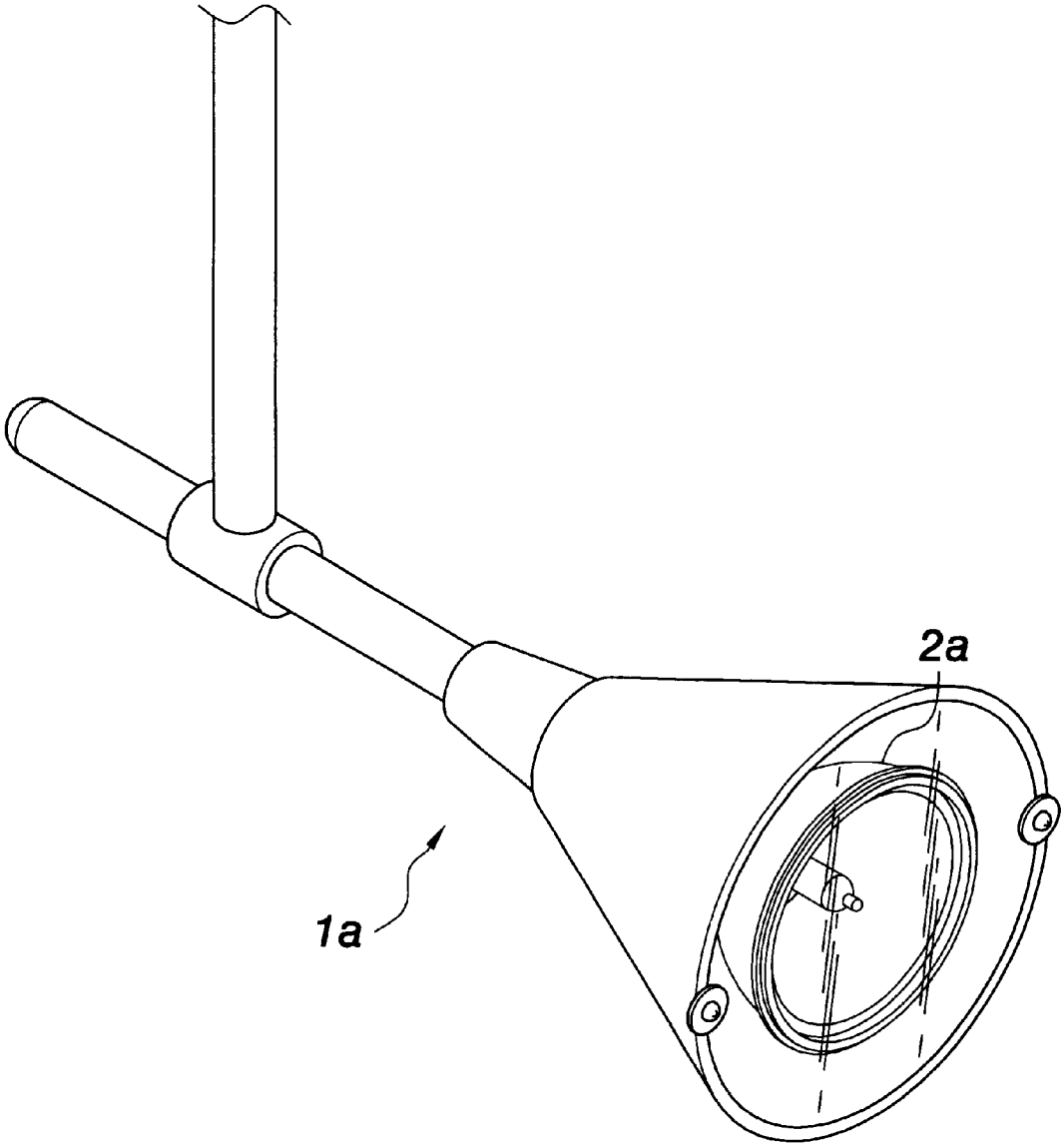
FIG. 1 PRIOR ART
FIG. 1 shows the perspective view of prior art projection lamp.
Figure 2:
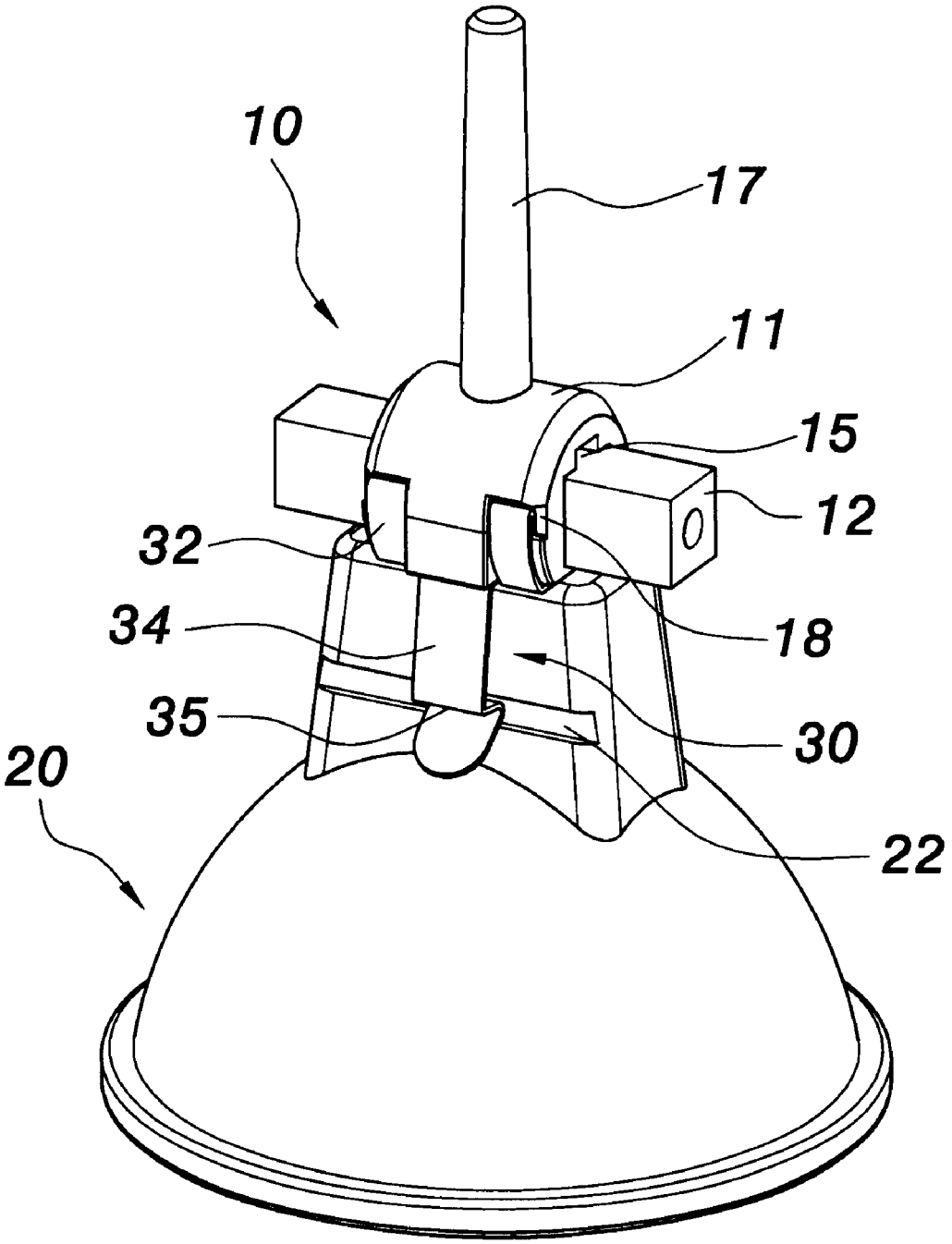
FIG. 2 shows the perspective view of the first preferred embodiment of the present invention.
Figure 3:
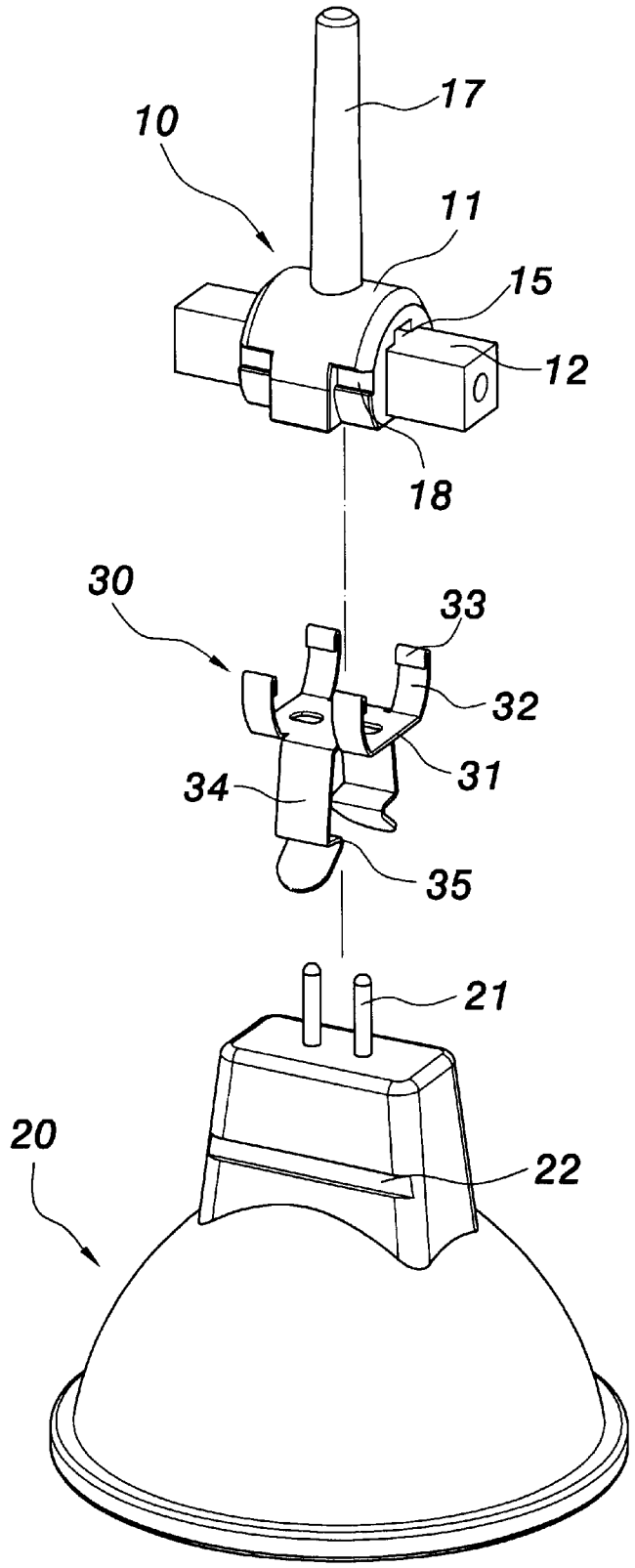
FIG. 3 shows the exploded view of the first preferred embodiment of the present invention.
Figure 4:
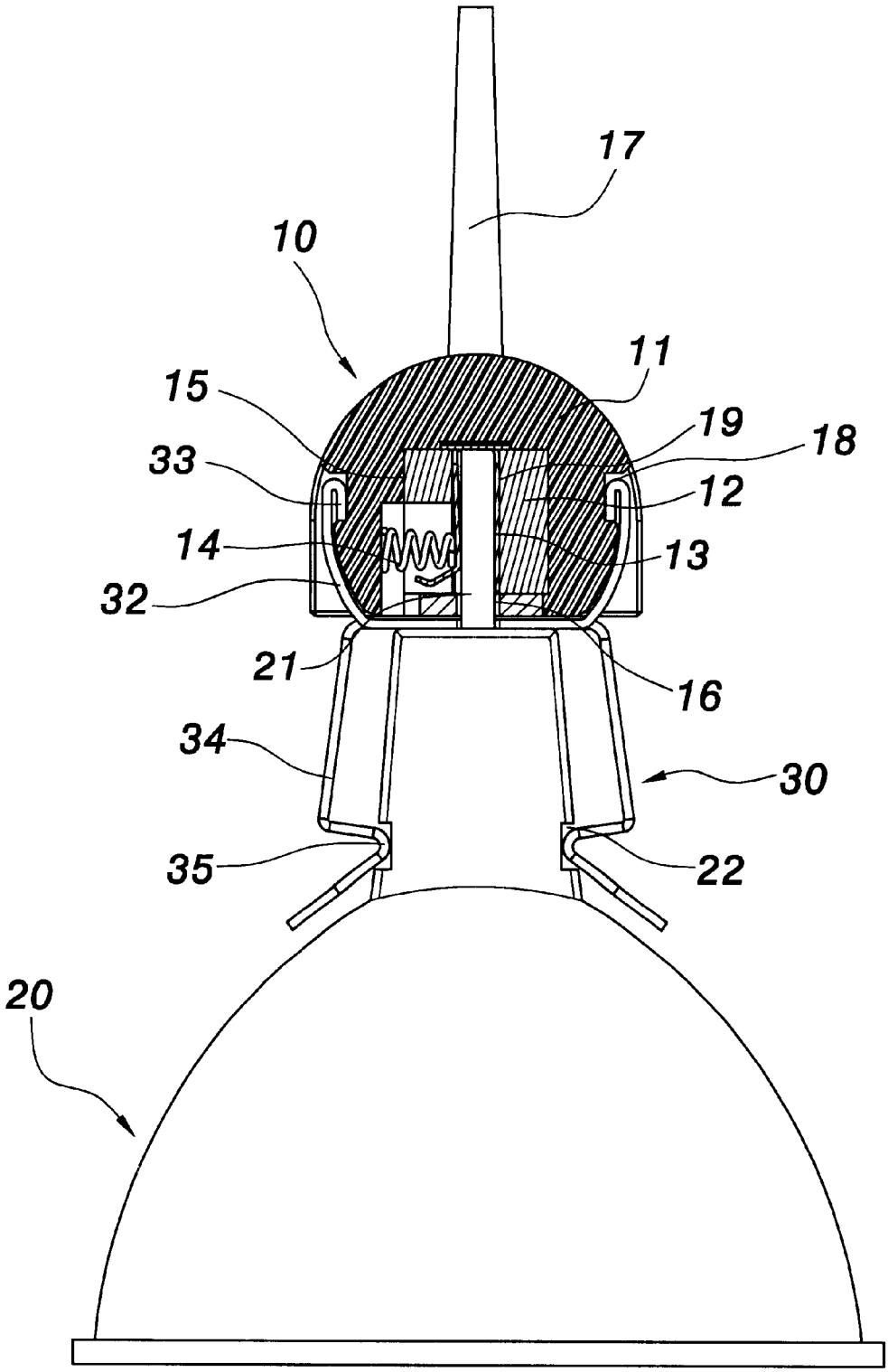
FIG. 4 shows the sectional view of the first preferred embodiment of the present invention.

As shown in FIGS. 2, 3 and 4, the present invention provides a clamping structure of projection lamp. The projection lamp in a preferred embodiment of the invention comprises a shade assembly 10, a lamp cup 20 and a clamping tongue 30. The shade assembly of projection lamp comprises an insulating body 11, two fixing members 12, two conductive plates 13 and two resilient members 14. The insulating body 11 is made of plastic material and has two receiving spaces 15 therein. The insulating body 11 has two insertion holes 16 passing through the internal part of the receiving space 15 to outside. The insulating body 11 has a projecting shaft 17 connected on outer wall thereof. By adjusting the projecting shaft 17, the angle of the shade assembly can be adjusted. The insulating body 11 has two grooves 18 on outer walls thereof and opposite to the projecting shaft 17.

The two fixing members 12 are made of coppers and have configurations corresponding to that of the receiving space 15 of the insulating body 11. The length of the fixing member 12 is greater than that of the receiving space 15. The fixing member 12 has a receiving recess 19 for conductive plate. The fixing member 12 is connected to a supportive member or a power unit (not shown), thus inputting power to the two fixing members 12. One end of the fixing member 12 is inserted into the receiving space 15 of the insulating body 11. Another end of the fixing member 12 is exposed out of the receiving space 15 by a specific length.

The conductive plates 13 are also made of coppers and are of U-shaped body. The two conductive plates 13 are arranged within the receiving recesses 19. The bottom ends of the conductive plates 13 face the insertion holes 16.

The resilient members 14 are provided between the insulating body 11 and the conductive plates 13. The resilient members 14 push the conductive plates 13 inward to enhance the clamping force exerted on the conductive plates 13.

The lamp cup 20 has similar structure as prior art lamp cup and has a bulb (not shown) therein. The lamp cup 20 has two leads 21 connected to the bulb; and has two grooves 22 on the outer walls thereof and extended along horizontal direction.

The two leads 21 of the lamp cup 20 are arranged within the conductive plates 13 and clamped by the conductive plates 13 such that the leads 21 are electrically connected to the fixing member 12 through the conductive plates 13. The electrical power can be conveyed to the two leads 21 through the fixing member 12 and the conductive plates 13. Moreover, the resilient members 14 push the conductive plates 13 inwardly to one lateral side such that the two leads 21 are firmly clamped between the conductive plates 13.

The present invention is characterized in that a clamping tongue 30 is provided between the shade assembly 10 and the lamp cup 20, whereby the shade assembly 10 and the lamp cup 20 are elastically connected by the clamping tongue 30. The clamping tongue 30 is made of metal with excellent elasticity and has a panel-shaped main body 31. The panel-shaped main body 31 has a plurality of upper arms 32 on two lateral sides thereof. The upper arms 32 have shapes corresponding to the shade assembly 10 such as arc shape etc. The upper arm 32 has inward-bent upper clamping part 33 on topside thereof. The panel-shaped main body 31 has a plurality of lower arms 34 on two lateral sides thereof. The lower arm 34 has inward-bent lower clamping part 35 on bottom side thereof.

The upper arms 32 lay on the outer walls on two lateral sides of the shade assembly 10 and the upper clamping part 33 clamps the two grooves 18 of the insulating body 11 such that the clamping tongue 30 is connected to the shade assembly 10. The lower clamping part 35 clamps the grooves 22 of the lamp cup 20 such that the clamping tongue 30 is connected to the lamp cup 20. By the clamping tongue 30, the shade assembly 10 and the lamp cup 20 are elastically connected.

Figure 5:
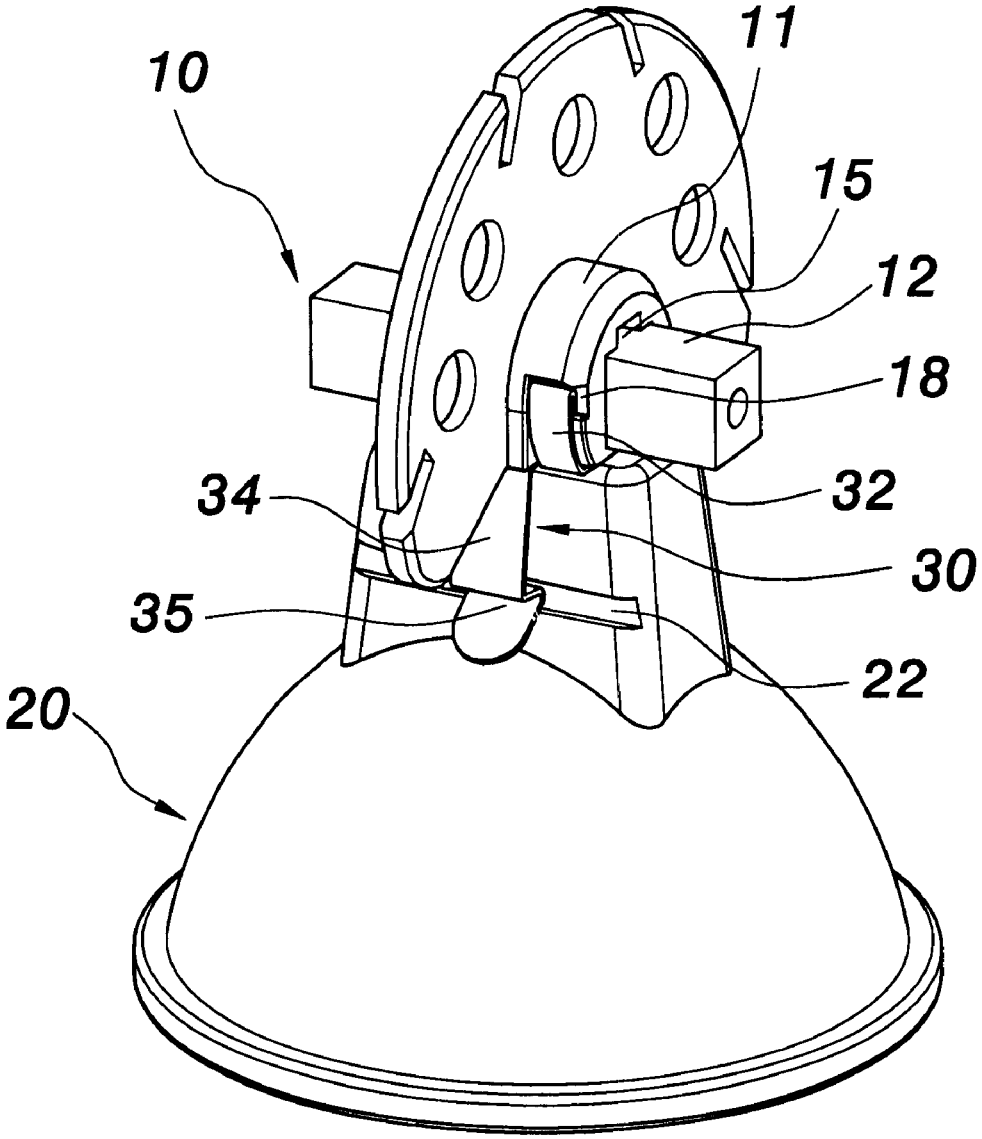
FIG. 5 shows the perspective view of the second preferred embodiment of the present invention.
Figure 6:
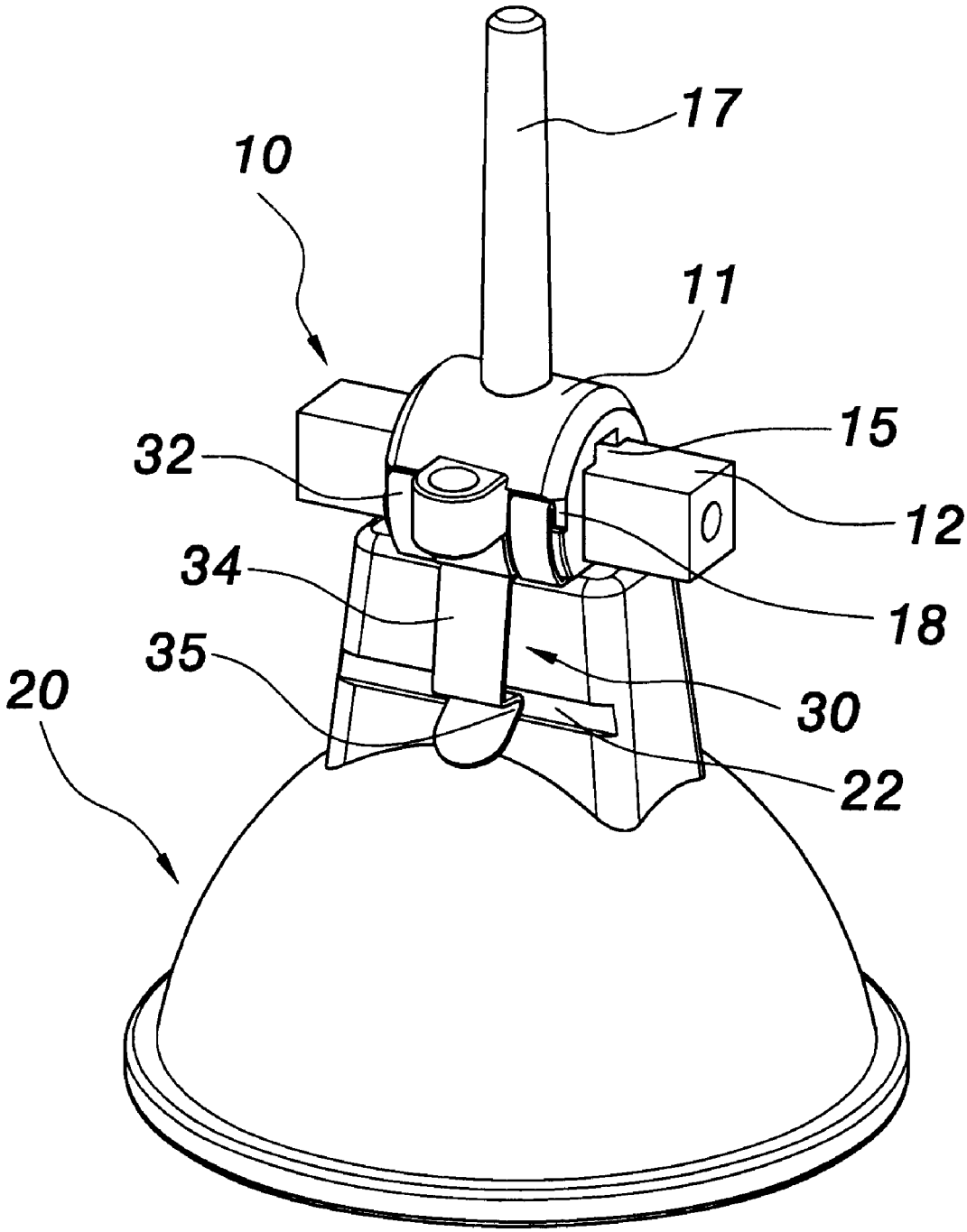
FIG. 6 shows the perspective view of the third preferred embodiment of the present invention.

As shown in FIGS. 5 and 6, the clamping tongue 30 of the present invention can be used to clamp the lamp cup 20 to the shade assembly 10 of various shapes and styles in case that the shade assembly 10 has grooves 18 on two lateral sides thereof, whereby the clamping tongue 30 utilizes the grooves 18 to clamp the lamp cup 20.

To sum up, by using the clamping tongue 30 of the present invention, the structure of the projection lamp can be greatly simplified. The lamp cup 20 can be clamped to the shade assembly 10 by the clamping tongue 30 in stead of nuts and screws.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A clamping structure of a projection lamp comprising:

a shade assembly having two grooves on two outer sides thereof;

a lamp cup inserted into the shade assembly and having two grooves on two outer sides thereof; and a clamping tongue having a resilient main body, the main body having a plurality of upper arms and lower arms on two opposite sides thereof, the upper arms having upper clamping parts and the lower arms having lower clamping parts;

the upper clamping parts of the upper arms clamping the grooves of the shade assembly and the lower clamping parts of the lower arms clamping the grooves of the lamp cup such that the lamp cup is elastically connected to the shade assembly.

2. The clamping structure as in claim 1, wherein the main body is of panel shape.

3. The clamping structure as in claim 1, wherein the upper arms are of arc shape.

* * * * *